United States Patent [19]

Baker

[11] 4,392,547

[45] Jul. 12, 1983

[54] HEARING AID EARMOLDS

[76] Inventor: Lawrence K. Baker, Kane St., Box 818, Gate City, Va. 24251

[21] Appl. No.: 272,502

[22] Filed: Jun. 11, 1981

[51] Int. Cl.[3] ..... H04R 25/00

[52] U.S. Cl. ..... 181/135

[58] Field of Search ..... 181/130, 135; 179/107 E, 107 BC

[56] References Cited

U.S. PATENT DOCUMENTS

| | | | |
|---|---|---|---|
| 261,822 | 8/1882 | Atkinson | 181/130 |
| 3,047,089 | 7/1962 | Zwislocki | 181/135 |
| 3,921,756 | 11/1975 | Johnson | 181/135 |
| 4,311,206 | 1/1982 | Johnson | 181/135 |

*Primary Examiner*—L. T. Hix
*Assistant Examiner*—Thomas H. Tarcza

[57] ABSTRACT

A resonant earmold for amplifying selected frequencies of the sound signal introduced into the earmold. The path for sound through the earmold includes transversely disposed, off-axis elongated chamber sections (24,25), the various sections functioning as a single acoustic chamber. Interchangeable inserts (30,50) of different dimensions are used, on a trial and error basis, for changing the dimensions of at least one of the sections for fine tuning the sound characteristics of the earmold to best match the hearing aid performance characteristics with the needs of the user.

6 Claims, 6 Drawing Figures

HEARING AID EARMOLDS

BACKGROUND OF THE INVENTION

This invention relates to hearing aids, and particularly to improvements in the earmolds of the horn or resonating type used in certain types of hearing aid systems.

It is known that best improvements in hearing are obtained by the use of hearing aids which provide a frequency dependent, variable amplitude output which matches the frequency variable hearing impairment characteristic of the hearing aid user. While frequency dependent, amplitude output sound shaping is possible with present day electronic amplifiers, it is known that the earmold portion of the hearing aid plays a significant role in the overall sound characteristic of the system. Because of this, it is the practice, in some instances, to use earmolds which are designed to resonate at selected frequencies to assist in the desired output sound signal shaping.

One earmold, for example, known as a Killion earmold (discussed, for example, in various articles in the October 1980 issue of the magazine, Hearing Instruments, Vol. 31, No. 10), is designed to function as an acoustic horn using the length and the cross-sectional area of the bore through the earmold as the design parameters to select the desired resonant frequency of the earmold.

One problem with such earmolds, however, as discussed on page 30 of the magazine, is that it is often not possible, owing to the anatomical characteristics of individual patients, to design an earmold which is both comfortable to the user and which has the necessary dimensions to provide a frequency characteristic which best matches the needs of the user. A further problem, not discussed in the magazine, results from the fact that the sound characteristics of the hearing aid are affected by the particular sound chamber formed by the combination of the earmold and the ear canal of the user. Thus, regardless of how carefully the earmold fitting process is performed and the earmold designed, it generally occurs that the final sound characteristics cannot be fully determined until the earmold is completed and tested on the patient. While such testing quite frequently reveals that the intended results have not been attained, with known earmolds few adjustments or modifications of the finished earmold can be made to better match their sound characteristics with the hearing requirements of the user.

SUMMARY OF THE INVENTION

An earmold according to one embodiment of this invention comprises a resonant chamber including at least two interconnected chamber sections, a first of which is adapted to introduce the sound signal into the ear canal of the user, and a second of which is disposed generally transverse to the first section and along an axis discontinuous therewith. The path for sound at the interface between the two sections preferably has a cross-sectional area no less than that of the section from which the sound is coming, whereby the two sections function as a single resonating chamber having a resonant frequency related to the combined lengths of the sections. To conserve space, and allow stacking of additional chamber sections, as desired, the second chamber section preferably has a non-circular and generally flattened cross-section. In one embodiment, the second chamber section is fitted with a movable member, e.g., a piston, by means of which the length of the section, hence the resonant frequency of the overall sound chamber, can be adjusted.

In another embodiment of the invention, an incomplete earmold is provided which includes a cavity or bore adapted to receive any one of a number of inserts, the insert defining a portion of the sound path through the earmold. Each of the inserts is dimensioned for proper fit within the cavity or bore, but the different inserts are of different dimensions and or configurations to provide sound paths of differing dimensions, hence of different sound, i.e., resonant characteristics. A trial and error process is used to select the insert providing the best hearing improvement for the user, and this insert is sealed in place to complete the earmold.

IN THE DRAWING

Figure 2:
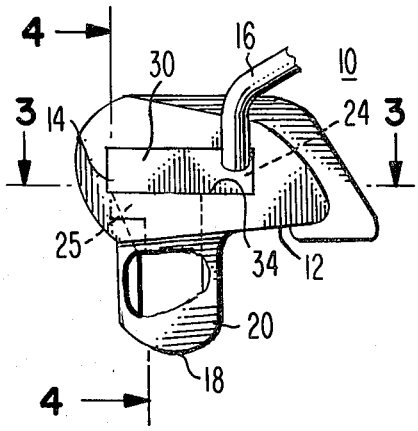
FIG. 2 is a plan view of the earmold as oriented in FIG. 1.
Figure 3:
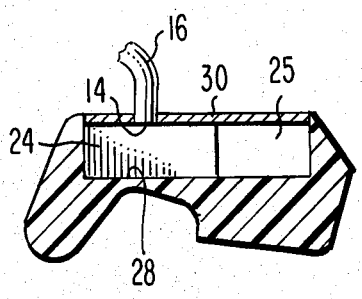
Figure 4:
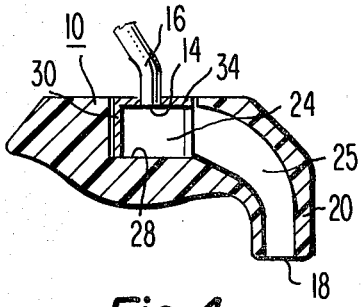
Figure 5:
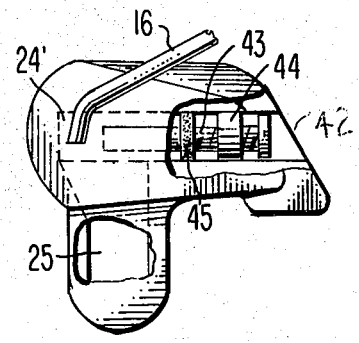
Figure 6:
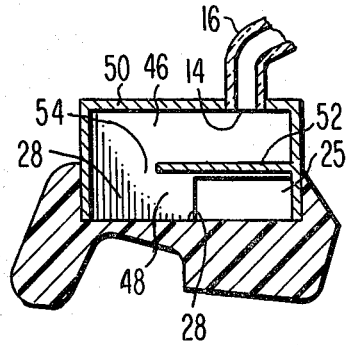

FIGS. 3 and 4 are cross-sectional views taken along lines 3—3 and 4—4, respectively, of FIG. 2;

FIG. 5 is a plan view similar to that of FIG. 2 but showing a different embodiment of the invention; and FIG. 6 is a cross-sectional view similar to that of FIG. 3 but showing a different insert.

DETAILED DESCRIPTION

With reference to FIGS. 1 through 4, an earmold 10 is shown of generally conventional external configuration and made of conventional material, e.g., a known plastic. The mold comprises a side surface 12 which is custom made to mate, in conventional manner, with the area within and around the concha portion of the ear of the user, an input port 14 into which can be inserted the end of a sound conduit tubing 16 extending from the audio amplifier portion of the hearing aid, and an output port 18 which transmits the sound signal into the ear canal of the user. In the illustrated embodiment, the output port 18 is at the end of a tubular extending portion 20 which extends into the ear canal of the user when the earmold is in place within the user's ear. To the extent so far described, the earmold 10 is similar to known earmolds.

Differing significantly from known earmolds, however, is the configuration of the path for sound between the input 14 and output 18 ports, and the means to provide such path. In known earmolds, the sound path generally comprises a continuous axis, gently curved, circular bore or passageway running between the input and output ports. While some degree of resonance is obtainable with such known earmolds, for the reasons previously referred to, relating to the fact that the ear canal extending portion of the earmold plays a major role both in affecting the sound characteristics of the earmold as well as its comfort to the user, such known earmolds are greatly limited in their design flexibility and utility.

In the inventive earmolds, conversely, the anatomical limitations imposed by the ear dimensions and shape are significantly overcome by the inclusion, as part of the path for sound through the earmold, of at least one elongated chamber section 24 (FIGS. 2 and 3) which is disposed transversely of the ear canal extending portion 20, that is, in a direction generally parallel to the ear lobe of the user when in place. The input port 14 opens into this chamber section 24, and the section 24 communicates, in turn, with a bore or sound path section 25 through the extending portion 20. Preferrably, to better utilize space, as discussed hereinafter, the section 24 is not of circular cross-section, but is generally of flattened or rectangular cross-section.

The path for sound through the earmold is thus from the input port 14, through the elongated chamber 24, and thence along the section 25 through the extending portion 20 to the ear canal of the user; the presence of the elongated chamber section 24 thus serving to increase the sound path length in comparison with conventional earmolds. That is, rather than comprising a basically single chamber sound path having a direct and continuous axis route through the earmold, earmolds according to this invention contain two or more chamber sections which are disposed transversely of one another to better utilize the space within the eammold for increasing the length of the sound path therethrough. Stated differently, the axis of the different chamber sections of this embodiment of the invention are not colinear, the elongated axis of the elongated section 24, for example, being off-set from the axis of the ear canal section 25 where the latter axis intersects the plane of the opening, i.e., the interface, between the two sections.

It is not sufficient, however, to merely provide means for increasing the length of the sound path through the earmold unless such increase also provides the desired sound characteristics, that is, a wider range of selectable resonant frequencies. In accordance with this invention, in addition to providing means for increasing the sound path length, by the better utilization of the space available within the earmold (without the need for larger earmolds), the resonant frequency of the earmold is made dependent upon the combined lengths of the multiple path sections by ensuring that the interfaces between the different path sections do not provide a significant constriction in the cross-sectional area of the sound path along the direction of sound flow. That is, at the section interfaces, the cross-sectional area of the sound path should not be significantly less than the cross-sectional areas of the immediately adjacent portions of the sections interconnected at the interface. Following section portions can be of equal or greater cross-sectional area, e.g., the following sections can have a flaring or horn-shaped configuration in the sound path direction away from the interface. By avoiding such "significant" sound path constrictions, the entire path for sound serves as a single resonant chamber, the fundamental frequency of which is proportional to the combined length of the chamber section in general accordance with the known "four times length" rule for air tubes.

Some small constrictions, however, are not fatal to obtaining such single chamber effect. For example, with quite small constrictions, the immediate effect is not to alter the frequency characteristics of the earmold, but merely to reduce the amplitude of the resonant frequency sound. Indeed, the use of such small constrictions is one means for selecting the sound characteristics of the earmold. Thus, while a trial and error process is presently required to determine the effects of sound path constriction, it is clear that the aforedescribed resonant chamber effects are achieved with little or no constrictions.

A further advantage of the better utilization of the available earmold space is that it allows the use of larger volume resonating chambers. This provides a greater amplification of the resonant frequency sounds, and also allows greater venting, as desired, of the sound path. Such venting, as known, increases the earmold wearing comfort of the user, and is effective for further accentuating the amplitude differences between the different frequency sounds, thus aiding the desired output sound shaping.

Further, because of the greater flexibility in design provided by the presence of the elongated section 24, anatomical variations and limitations presented by the user's ear become of much lesser importance in the design and proper functioning of the earmold. That is, in the inventive earmolds, the tubular portion 20, or its equivalent, can be designed primarily for the purpose of providing maximum comfortable fit of the earmold to the user, and the desired accoustical characteristics can be obtained via the design of the section 24, the parameters of this section having little effect on the comfort of the earmold to the user.

Figure 1:
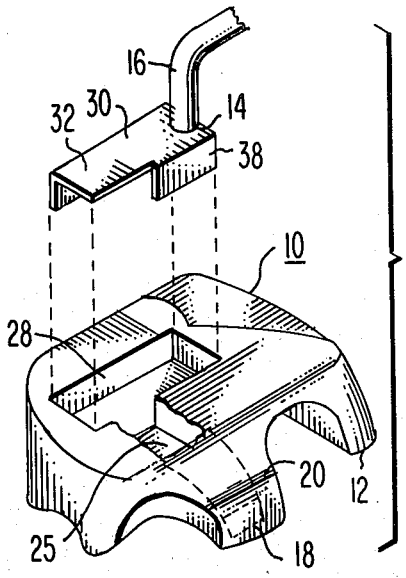
FIG. 1 is an exploded view, in perspective, of an earmold according to this invention.

Returning to a description of the earmold 10, FIG. 1 shows that the elongated section 24 is formed by the combination of an elongated, generally rectangular cavity 28 in one side of the earmold body, and a generally U-shaped insert 30 having an opening through the transverse wall 32 thereof to receive the end of the sound conduit tubing 16 from the amplifier of the hearing aid. The insert 30 can have other shapes, e.g., tubular.

The ear canal section 25 opens into the cavity 28 through an opening through a wall 34 (FIG. 2) thereof, and a portion of one of the side walls 38 of the insert 30 is removed to provide communication between the two sections 24 and 25.

In another embodiment, not shown, a molded ledge is provided just inside the upper edge of the cavity 28, and the insert comprises simply a flat plate which rests on the ledge and closes the cavity. In a finished earmold, the insert can be bonded in place within or over the cavity.

In the embodiment illustrated in FIGS. 1 through 4, the insert 30 extends the full length of the cavity. However, by shortening the length of the insert, as by sliting the transverse wall 32 along its corners and bending it down, the effective length of the section 24 is effectively reduced. Thus, by the use of different inserts, different length chamber sections 24 can be provided resulting in different sound characteristics for a given earmold body, and an optimum matching of the sound characteristics of the earmold with the needs of the user can be obtained.

In other embodiments, not illustrated, a single insert can be used which fits snugly within the cavity, but different length plugs of wax or the like can be inserted into the end of the insert to change its effective length, hence the overall length of the sound path.

In another embodiment, an elongated sound path section 24' (FIG. 5) comprises an elongated bore in the earmold body from an end 42 thereof, the closed end of the bore communicating with the section 25. The inserts in this embodiment can comprise different length plugs (not shown) which are inserted, in snug fit, into the bore through its open end or, as illustrated, an elongated rod 43 extending into the bore through its open end and rotatably held in place therein by means of a collar 44 snugly fitting within the bore end. A plug 45 is mounted, in threaded relation, on the rod 43, rotation of which causes movement of the plug 45 thereby changing the effective length of the section 24'.

As desired, even longer chamber lengths, for lower resonant frequencies, can be obtained by arranging two (or more) elongated sections 46 and 48 in stacked relation, as shown in FIG. 6. In this embodiment, which also uses an elongated, rectangular cavity 28, the insert 50 is similar to the insert 30, but is larger and is subdivided by a "horizontal" (in the orientation shown) wall 52 into the two sections 46 and 48.

The input port 14 for sound is at one end of the section 46, and the sound interface 54 between the two sections is at the other, the path for sound thus making an abrupt return-bent turn. The interface, or opening, between the two sections 46 and 48 is provided by the removal of an end portion of the transverse wall 52. Again, provided that the area of this interface between the two sections is comparable to the cross-sectional area of the section 46 at the interface, the resonant frequency of the earmold is a function of the combined lengths of all the chamber sections in accordance with the known "four times length" rule for air tubes.

The fact that this rule prevails suggests that earmolds according to my invention function as a wind instrument, such as a trumpet, having various convoluted sound paths, the fundamental frequency of which are dependent substantially solely on the lengths of the paths. By analogy with such musical instruments, it is clear that the various interconnected chamber sections of my earmolds can assume any number of different configurations and orientational relationships for best utilizing the available space provided the aforementioned requirements at the interfaces between the various sections are satified.

Returning to a consideration of the embodiment illustrated in FIG. 5, it is noted that the input port 14 is disposed at that end of the section 24' at which is disposed the opening into the section 25; a quite short path between the input port 14 and the section 25 thus existing. In spite of such apparent "short circuiting" of the section 24', and the fact that its other end is thus an apparent "dead-end" for sound travel, the length of the section 24' adds to the effective length of the earmold sound path with respect to its resonant frequency.

In the embodiment shown in FIG. 6, the two sections 46 and 48 provide, as aforedescribed, a continuous zigzag path for the sound. Alternately, the opening 54 through the wall 52 can be disposed at the right-hand (as viewed in FIG. 6) side wall of the insert 50, with the wall 52 being connected to the left-hand side wall. In such case, as in the FIG. 5 embodiment, a quite short path exists between the input port 14 and the opening to the section 25, and both sections within the insert are apparent dead-ends for sound at the right-hand side wall. Still, as is the case for the FIG. 5 embodiment, the length of these sections contributes to the effective overall length of the sound path and gives rise to resonances at lower frequencies in proportion to the increased lengths and numbers of the sections provided by the insert.

As previously noted, an advantage of the present invention is the ability to obtain a resonance at a desired frequency without sacrificing comfort of the user and without, in general, requiring the use of earmolds larger than those used in the prior art. The latter advantage arises, as above noted, from the use of the discontinuous axis chamber sections and the use of non-cicrular cross-sections for making best use of the available volume within the earmold. In one embodiment, for example, the dimensions of the section 28 (FIG. 1) are 500 mils long, 125 mils deep, and 250 mils wide. The insert 30 is of 5 mil thick material, e.g., metal or plastic, has a depth of 125 mils, and fits snugly within the section 28. The cross-sectional dimensions of the section 25 are also 125×250 mils, and is of a length of 250 mils. The combined length of the two sections is thus around 0.7 inches and the resonant frequency of the earmold centers at around 4500 cps. Such a resonant frequency corresponds generally, to the 4 times length rule for air tubes.

Similarly, in one embodiment of the type shown in FIG. 6, the dimensions are the same except that the insert 50 has a depth of 250 mils, each section 46 and 48 having a depth of around 125 mils. and the presence of the two sections providing a combined chamber length, including the section 25, of around 1.2 mils. The resonant frequency of this earmold centers around 2700 cps, which is also in general agreement with the 4 times length rule.

A preferred means for fitting and fabricating earmolds according to my invention is now described.

An earmold body is first made using, if desired, conventional techniques. For example, a wax impression is made of the concha and surrounding portions of the patient's ear, the impression is used to make a mold, and the material of the earmold, e.g., a known plastic, is poured into the mold and allowed to harden. Then the earmold cavity or bore (referred to jointly as "recess" hereinafter) is formed in the body, and a bore drilled through the extending ear canal portion to intersect the recess.

Alternatively, a form made from a material not wet by the plastic and having a shape corresponding to the desired chamber sections is disposed in the mold, and the plastic poured therearound to form the earmold body having the desired internal recesses or passageways. The form is then removed.

Preferably, the recess is of a preselected size, and then, using a combination of the tested hearing requirements of the patient and the known frequency characteristics of different hearing aid amplifiers and earmolds, different inserts providing different sound characteristics are selected and placed in the recess and the patient's response to each, as part of a hearing aid system, is evaluated. The insert providing the best results is then sealed in place to close the recess and complete the earmold. Thus, the finished earmold, and the hearing aid system are "fine tuned" to provide the best results for the user.

Preferably, a stock of different inserts is available to the fitting audiologist, each properly fitting within a recess of preselected dimensions; such a dimensioned recess being incorporated in each of the otherwise custom fitted earmold prepared for each of different patients. By so stocking the various inserts, which are interchangably fittable within otherwise custom fit earmolds, both the advantages of accuracy and cost, associated with mass production techniques usable to make the inserts, and custom fitting of the earmold to each patient for maximum comfort and utility, are achieved.

Conversely, the feature of "fine tuning" or adjustability of the finished earmold can be dispensed with, and a finished earmold, having one or more length sections in accordance with this invention can be provided based solely upon the results of conventional patient testing and evaluating procedures. While not the preferred approach, still because of the added flexibility in design provided by the incorporation of the additional sections, e.g., the section 24 shown in FIGS. 1–4, earmolds providing both comfort and generally desired frequency characteristics can be thus readily provided.

What is claimed is:

1. A hearing aid earmold for amplifying selected sound frequencies including a resonant chamber characterized as comprising at least two interconnected chamber sections, a first (25) of which is adapted to extend into the ear canal of the user, and a second (24) of which is disposed generally transversely of the first section and along an axis discontinuous therewith, the cross-sectional area of the interface between said two sections being not significantly less than that of said second section along a portion thereof adjacent to said interface, the resonant frequency of said chamber being a function of the combined lengths of said two sections.

2. An earmold according to claim 1 characterized in that said second section has a generally flattened cross-section.

3. An earmold according to claim 1 characterized as including a moveable member (45) disposed within said second section, and means for moving said member for altering the dimensions of said second section for altering the acoustical characteristics of said chamber.

4. An earmold according to claim 1 characterized in that said second section comprises a recess formed within the body of said earmold and an insert (30,50) disposed within said recess for defining certain dimensions of said second section.

5. An earmold according to claim 4 characterized in that said insert has an internal structure (52) defining two parallel chamber sections (46,48) within said recess.

6. A hearing aid earmold kit comprising means for forming an incomplete earmold body including a tubular extension adapted to extend inwardly of the ear canal of a user of the hearing aid, said extension opening into a cavity in a side of said body, said cavity extending transversely of said tubular extension and along an axis discontinuous therewith, and a plurality of inserts adapted to be individually assembled into mating relation with said cavity, each so assembled insert forming a chamber section communicating with said extension and providing, in cooperation therewith, a path for sound through said insert assembled body, said path comprising a resonant chamber whose resonant frequency is a function of the entire length of said path, different ones of said inserts having different dimensions providing different dimensioned sound paths, and input port means for introducing sound into the sound path of an assembled earmold.

* * * * *